United States Patent [19]

Greiser et al.

[11] Patent Number: 4,627,811

[45] Date of Patent: Dec. 9, 1986

[54] APPARATUS FOR PRODUCING A SPUNBOND

[75] Inventors: Wolfgang Greiser, Neusäss; Hans Wagner, Bobingen, both of Fed. Rep. of Germany

[73] Assignee: Hoechst Aktiengesellschaft, Fed. Rep. of Germany

[21] Appl. No.: 692,305

[22] Filed: Jan. 17, 1985

[30] Foreign Application Priority Data

Jan. 19, 1984 [DE] Fed. Rep. of Germany ..... 3401639

[51] Int. Cl.[4] ..... B29C 47/14; B29C 47/88

[52] U.S. Cl. ..... 425/72 S; 425/377; 425/378 S

[58] Field of Search ..... 425/72 S, 377, 378 S

[56] References Cited

U.S. PATENT DOCUMENTS

| | | | |
|---|---|---|---|
| 1,856,401 | 5/1932 | Prince | 425/72 S |
| 1,885,256 | 11/1932 | Gull | 425/72 S |
| 2,451,854 | 10/1948 | Mehler | 425/72 S |
| 3,551,949 | 1/1971 | Leyborne et al. | 425/72 S |
| 4,340,563 | 7/1982 | Appel et al. | 425/72 S |

FOREIGN PATENT DOCUMENTS

| | | | |
|---|---|---|---|
| 506975 | 8/1930 | Fed. Rep. of Germany | 425/72 S |
| 1013035 | 8/1957 | Fed. Rep. of Germany | 425/72 S |
| 475406 | 12/1937 | United Kingdom | 425/72 S |

*Primary Examiner*—Willard E. Hoag

*Attorney, Agent, or Firm*—Connolly and Hutz

[57] ABSTRACT

An apparatus for producing a spunbond by pneumatic take-off and laying of melt-spun filaments comprises a superatmospheric pressure chamber which is connected to the melt spinneret in a gas-tight manner and has discharge orifices for the filaments. Said superatmospheric pressure chamber tapers weekly conically into a drawing cell. The aperture angle of the weakly conical superatmospheric pressure chamber is less than 7°. The filaments are spun in the form of a linear curtain into the interior of the superatmospheric pressure chamber which is just as wide as the curtain. One side of the conical portion and of the drawing cell is moveable and, at the start of the melt spinning, can be moved away from the other wall, so that the start-up of spinning is facilitated.

5 Claims, 3 Drawing Figures

APPARATUS FOR PRODUCING A SPUNBOND

Figure 3:
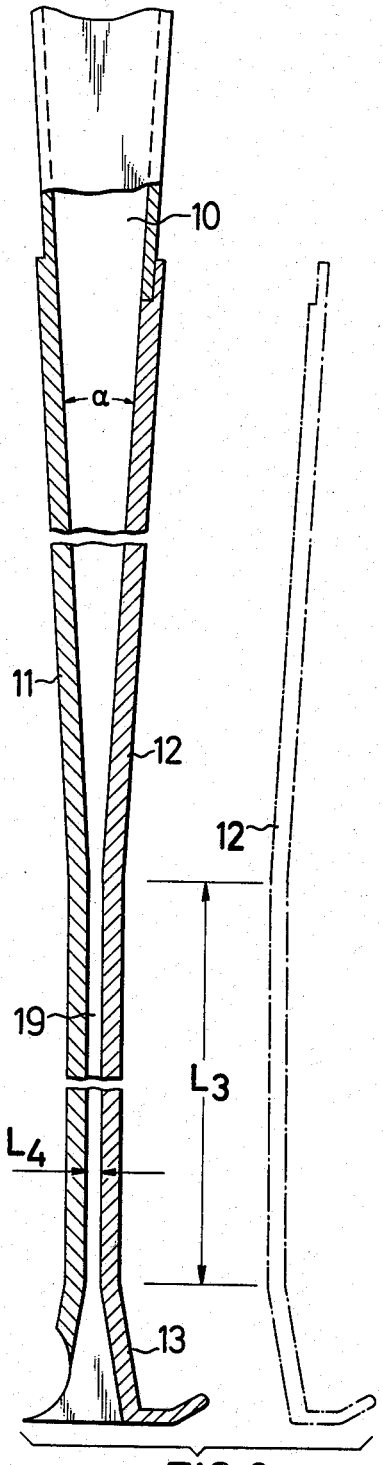

The invention relates to apparatus for producing a spunbond by pneumatic take-off and laying of melt-spun filaments, this apparatus comprising a superatmospheric pressure chamber which is connected in a gas-tight manner to the melt spinneret and has discharge orifices for the filaments.

Apparatus of this type is known from British Pat. No. 1,082,224, wherein it is also pointed out that this apparatus is suitable for so-called curtain spinning. The apparatus produces high-stretch filaments, as is evident from the examples.

These spinning ranges with superatmospheric pressure chamber are exhaustively discussed in German Offenlegungsschrift No. 2,016,860, where the discharge orifices take the form of channels which are at least 20 mm, preferably 50–300 mm, in length. This design ensures improved transmission of force from the air flow to the filaments and correspondingly, improved orientation of said filaments, as is apparent for example from example 10 of said Offenlegungsschrift.

The diameter of these channels must be relatively large to permit the start-up of spinning, when the freshly spun filaments are guided through the discharge orifices by means of thin wires inserted from the discharge end. This way of starting up spinning also prohibits greater channel length.

In the specification of German Offenlegungsschrift No. 2,016,860 it is also stated that this apparatus is only suitable for circular jet hole arrangements and not for so-called curtain spinning.

It is therefore the object of the present invention to provide apparatus which is suitable for curtain spinning i.e. for spinning from spinneret holes arranged in rows, and facilitates the start-up process.

The apparatus according to the invention comprises, underneath a spinneret where the holes are in rows, a superatmospheric pressure chamber, known per se, which then tapers weakly conically into a drawing cell 19 which is of constant width and preferably has a length of over 1 m.

The aperture angle $\alpha$ of the weakly conical portion 10 of the superatmospheric pressure chamber is preferably less than 7°.

The air is particularly preferably fed into the superatmospheric pressure chamber through two horizontal rows of blow nozzles which comprise metal sinters and are arranged opposite each other and after which the air flow is preferably deflected in the direction of the running filaments.

The drawing cell 19 of constant width preferably contains at its discharge end a widening end portion 13.

In a preferred embodiment, at least one side of the conical portion 10 of the pressure chamber and of the drawing cell 19 is moveable.

The apparatus according to the invention is particularly suitable for curtain spinning ranges where the spinneret holes are in a linear arrangement across the entire width of the web, as described in German Auslegeschrift No. 2,048,006. In this case, the apparatus according to the invention likewise extends over the entire width of the web. To start up in this case, one of the two walls of the conical portion 10 and of the drawing cell 19 is swung or slid out of the way.

The superatmospheric pressure chamber is directly attached to the actual spinning range in a manner known per se. The air supply 8 to the superatmospheric pressure chamber is arranged at some distance from the spinneret surface. The distance is chosen to be such that the spinneret surface is no longer impaired by the air blown in. For the same reason, it is also advantageous to deflect the flow in the direction of the running filaments. Blowin nozzles of this type are state of the art and need only be adapted to the specific design of the spinning range when employed for curtain spinning.

The aperture angle $\alpha$ of the slightly conically tapered portion 10 of the superatmospheric pressure chamber is chosen to be less than 7° in order to keep the air flow as steady as possible.

The subsequent drawing cell 19 is for drawing the filaments and, in order to transfer the necessary drawing forces there, usually has a length of more than 1 m. The drawing cell is of low width, so that the free area per filament is about one square millimeter. In the web-spinning range described in German Offenlegungsschrift No. 2,016,860, the free area in the channels is about 20 to 50 $mm^2$.

These narrow drawing cells 19 require a start-up aid which, according to the invention, resides in the fact that a longitudinal wall 12 of the drawing cell 19 can be moved out of the way. Depending on the available space, the longitudinal wall can either be swung out of the way or be slid out of the way in the transverse or longitudinal direction. In this arrangement, it is particularly important to ensure that, in the closed position, the cell is satisfactorily sealed off, since the filament curtain reacts sensitively to turbulent air flow and the like.

This start-up aid makes it possible to use a long drawing cell 19 which produces correspondingly highly oriented filaments. The force transmitted from the air flow to the filaments increases, approximately, with the square root of the length of the drawing cell 19. The examples demonstrate the effect of cell length.

The superatmospheric pressure inside the chamber can be chosen to be much less than the air pressure in a state of the art injector nozzle, for example that described in German Offenlegungsschrift No. 2,048,006. A superatmospheric pressure of only 0.4 bar was found to be sufficient for the spinning range shown in more detail in the example.

The low cross-sectional area of the filament curtain, moreover, correspondingly requires only a small aspirated area on the moving belt. The air aspirated there can be compressed in one or more stages and be reused as drawing air.

The present invention thus combines the advantages of the spunbond range with superatmospheric pressure chamber, namely the low air consumption and the high uniformity of the filament curtain across the width of the range, with the advantages of spinning ranges which produce highly oriented filaments by means of injector nozzles and drawing pipes.

The present invention is described in more detail by reference to drawings and by means of a preferred example. The numbers and the figures have the following meanings: 1 pack, 1' spinneret holes, 2 spinning tank, 3 gas-tight cover on the opening for installing the pack 1, 4 thermal insulation, 5 top portion of pressure vessel, 6 downward-pointing air blinds, 7 metal sinters, 8 air supply, 9 filaments, 10 tapering portion of pressure vessel, 11 stationery cell wall, 12 mobile wall, 13 widening of cell, 14 heated roll, 15 support roll, 16 sieve belt, 17 preconsolidated web, 18 aspiration, $L_1$ length of top portion of pressure vessel, $L_2$ length of tapering portion of pressure vessel, $L_3$ length of cell 19, $L_4$ width of cell, 19 cell.

Figure 1:
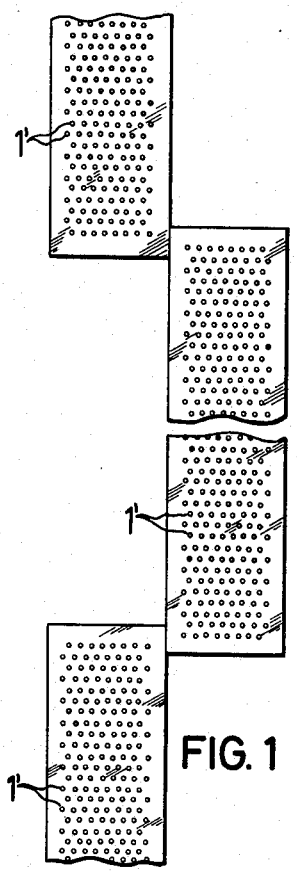

FIG. 1 shows a possible arrangement of the spinneret holes 1' in a rectangular pack 1. These packs are installed in the spinning tank 2 in the offset manner depicted, in order to obtain a filament curtain without gaps.

Figure 2:
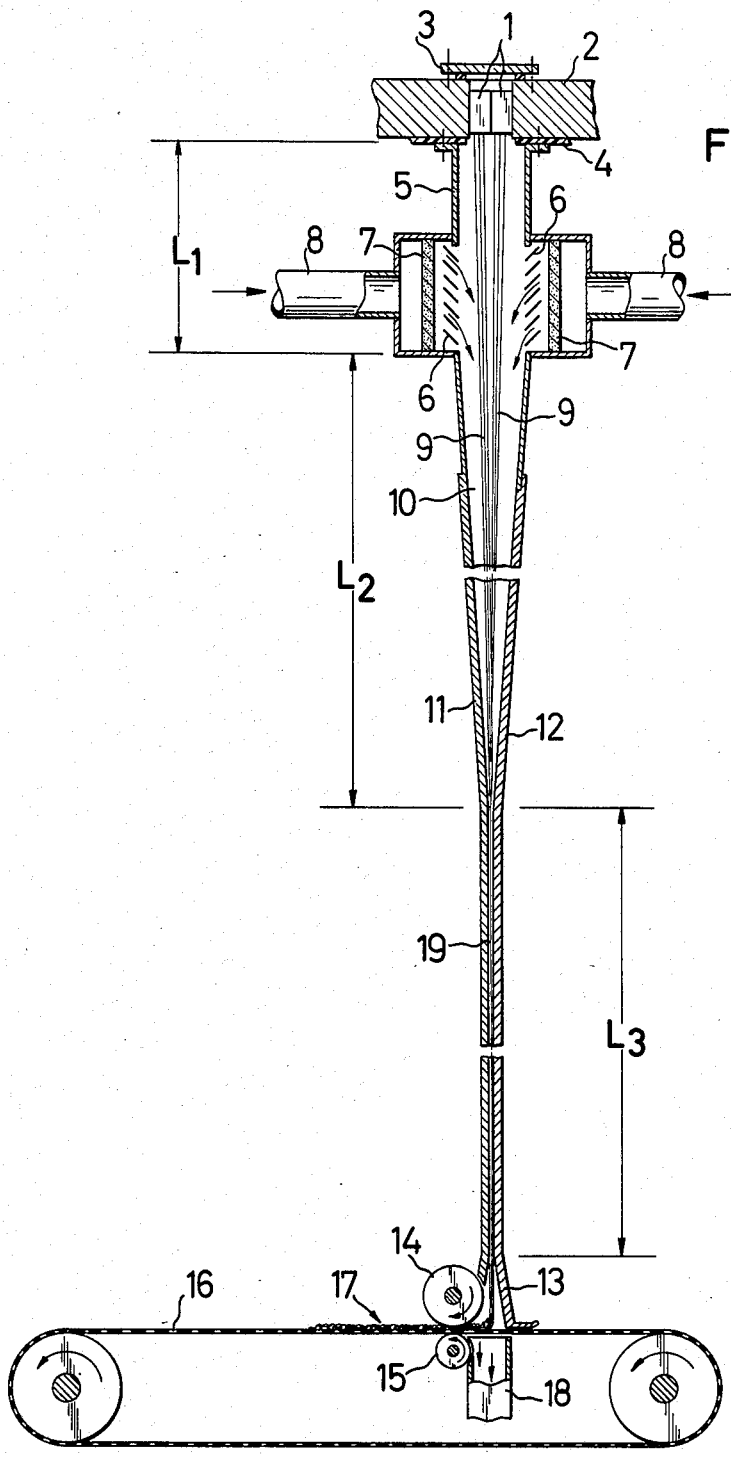

FIG. 2 shows a section through the entire aparatus for producing a spunbond. The horizontal cross-sections through the upper portion 5 and the tapering portion 10 of the pressure vessel and through the cell 19 are all rectangles, the length of which depends on the width of the spun web to be produced.

FIG. 3 shows in enlarged form a detail from FIG. 2, namely the transition from the tapering portion of the pressure vessel to the cell 19. The dotdash lines indicate the start-up position of the hydraulically moveable cell wall 12. It is sufficient to shift component 12 in the parallel direction by about 30 mm out of the closed position drawn in solid lines to ensure that, at the start-up of spinning, the filaments fall freely through the cell 19 thus widened onto the moving belt 16.

EXAMPLE 1

An apparatus as in FIG. 2 was used to produce a polyethylene terephthalate spunbond.

The main dimensions of the spinning range were: $L_1=500$ mm; $L_2=1500$ mm; $L_3=1500$ mm; internal width of pressure vessel 5 at the top: 200 mm; internal width of cell exit $L_4=2$ mm.

4 packs 1 of the type depicted in FIG. 1 were used to spin a filament curtain of 104 cm in width. The melt temperature was 295° C., the viscosity of melt was 220 Pas, and each pack 1 had 520 spinneret holes 1' of 0.5 mm in diameter. The total output of the spinning range was 3.95 kg/min.

To start-up the spinning range, the shiftable wall 12 was shifted toward the right by 30 mm. Only then were the spinning pumps switched on, and the spun filaments 9 fell without problem down to the sieve belt 16. The aspiration 18 and the moving sieve belt 16 ensured a constant uninterrupted transport of filaments 9. The pressure vessel was not brought up to a constant superatmospheric pressure of 0.4 bar until the wall 12 had been closed.

The air supplied at 8 was constantly adjusted to 35° C. and a dew point of 20° C. The air speed immediately after the metal sinters 7 was measured as 0.3 m/s. The total area of the metal sinters 7 was 0.6 $m^2$. The width of the pressure vessel and of the cell (not shown in the drawing) had been chosen to be 1.2 m, so that the ends of the 104 cm wide filament curtain could not be impaired by edge effects of the flow in the cell 19. The filaments spun with this set-up had the following properties:

Linear density: 3.6 dtex
Specific tear strength: 0.34 N/tex
Elongation at break: 70%
Shrinkage: 4%
Birefringence: $103\times10^{-3}$.

For web formation, the sieve belt 16 was at a speed of 76 m/min. The aspiration 18 was adjusted in such a way that the vertical air flow within the web-laying zone immediately above the sieve belt was 4 m/s. The web produced under these conditions was about 1 m wide and had a weight per unit area of 50 g/$m^2$. The web was preconsolidated while still on the moving belt by means of the heated roll 14 (190° C.) and the support roll 15. The uniformity of the spun web produced was characterised by a coefficient of variation for the weight per unit area of 6% and thus very good. The diameter of the round spot for measuring the weight per unit area was 30 mm.

Shorter lengths $L_3$ of the cell 19 and an otherwise unchanged experimental setup produced the following filament properties:

| | $L_3$ = 1.0 m | $L_3$ = 0.2 m |
|---|---|---|
| Linear density | 4.0 dtex | 5.5 dtex |
| Specific tear strength | 0.32 N/tex | 0.26 N/tex |
| Elongation at break | 82% | 124% |
| Shrinkage at 200° C. | 5.4% | 10.4% |
| Birefringence | $93\times10^{-3}$ | $61\times10^{-3}$ |

These values show that, under the desired low pressure in the pressure vessel, the cell had to be more than 1 m in length in order to obtain adequate textile properties for the filaments.

We claim:

1. In an apparatus for producing a spunbond by pneumatic take-off and laying of melt-spun filaments including a superatomospheric pressure chamber connected to melt spinneret in a gas-tight manner and having discharge orifices for the filaments, the improvement according to which the superatomspheric pressure chamber has a gradual tapering portion merging into a drawing cell, air supply means connected to supply the superatomspheric pressure chamber with air through two opposite rows of air supply means arranged at some distance from the spinnerets, and deflection means disposed to deflect air flow from the supply means in the direction of filament movement.

2. The apparatus as claimed in claim 1 wherein the gradual tapering portion of the superatmospheric pressure chamber has an aperture angle less than 7°.

3. The apparatus as claimed in claim 1 wherein the filaments are spun in the form of a linear curtain and the interior of the superatomspheric pressure chamber is elongated in a direction transverse to the direction of filament movement.

4. The apparatus as claimed in claim 1 wherein the drawing cell has an outwardly flared outlet end portion.

5. The apparatus as claimed in claim 1 wherein the gradual tapering portion of the superatmospheric pressure chamber and the drawing cell include at least one movable side wall portion.

* * * * *